US005249653A

United States Patent [19]

King

[11] Patent Number: 5,249,653

[45] Date of Patent: Oct. 5, 1993

[54] HAND LUGGAGE WITH INTELLIGENT OPENING FEATURE

[75] Inventor: William L. King, Denver, Colo.

[73] Assignee: Samsonite Corporation, Denver, Colo.

[21] Appl. No.: 946,047

[22] Filed: Sep. 15, 1992

Related U.S. Application Data

[63] Continuation of Ser. No. 854,505, Mar. 19, 1992, abandoned.

[51] Int. Cl.[5] ..... A45C 3/02; A45C 13/00

[52] U.S. Cl. ..... 190/109; 190/30; 190/111; 190/900; 190/901

[58] Field of Search ..... 190/30, 109, 111, 112, 190/119, 900, 901

[56] References Cited

U.S. PATENT DOCUMENTS

| | | | |
|---|---|---|---|
| 299,812 | 6/1884 | Lazarus . | |
| 370,866 | 10/1887 | Hallberg | 190/30 |
| 919,076 | 4/1909 | Rangnow | 190/30 |
| 1,266,647 | 5/1918 | Wickberg . | |
| 1,331,033 | 2/1920 | Sirolla . | |
| 1,533,402 | 4/1925 | Gillet . | |
| 1,755,475 | 4/1930 | Fairleigh | 190/30 |
| 1,795,997 | 3/1931 | Caro . | |
| 1,968,643 | 7/1934 | Hamlin | 190/109 |
| 1,984,446 | 12/1934 | Wheary | 190/109 |
| 2,091,651 | 8/1937 | Platt et al. | 190/109 |
| 2,148,244 | 2/1939 | Plotkin | 190/109 |
| 2,316,979 | 4/1943 | Shipley . | |
| 2,317,083 | 4/1943 | Plotkin | 190/115 |
| 2,479,269 | 8/1949 | Schneider . | |
| 2,518,256 | 8/1950 | Schall . | |
| 3,112,017 | 11/1963 | Lifton . | |
| 3,756,639 | 9/1973 | Wilkinson . | |
| 3,828,899 | 8/1974 | Scott . | |
| 3,912,055 | 10/1975 | Malooly . | |
| 4,020,930 | 5/1977 | Weber . | |
| 4,652,029 | 3/1987 | Yamamoto . | |
| 4,714,286 | 12/1987 | Yamamoto . | |
| 4,844,214 | 7/1989 | Castelli et al. | 190/900 |
| 4,865,368 | 9/1989 | McCall . | |
| 4,925,021 | 5/1990 | Pulichino, Jr. | 190/112 |
| 4,976,340 | 12/1990 | Bieber et al. | 190/109 |

OTHER PUBLICATIONS

Starco Ad. Sep. 1989 issue of Travelware Magazine, Style #9111 "Organizer".

Samsonite Catalog Sheet, copyright 1986, Classic® 100 Catalogue Case.

*Primary Examiner*—Gary E. Elkins

*Attorney, Agent, or Firm*—Gregory W. O'Connor

[57] ABSTRACT

Attache cases and business cases in general typically have a portfolio section for organizing papers and a main packing section. Depending on the needs of the user, these portions can be selectively closed off. However, it's best that these sections are relatively accessible depending on whether the case is opened from the vertical position or whether the case is opened from the horizontal position. Accordingly, Applicant has provided a portfolio catch system which, depending on the orientation of the case, holds the portfolio in a closed position where the front of the portfolio is attached to the lid portion of the case, or in the alternative, if the case is opened from the vertical position, the panel is held to the base of the case, thus preventing the contents of the base from spilling and automatically permitting ready access to the contents of the portfolio. Also disclosed is a series of lid containers and base containers arrayed along the upper edge of the lid and base shells at the upper side of the case. These containers are readily accessible in all conditions of the case, and are especially accessible when the case is opened from the vertical position wherein access to the contents of the portfolio, as well as these lid and base containers, can be readily had.

12 Claims, 3 Drawing Sheets

HAND LUGGAGE WITH INTELLIGENT OPENING FEATURE

This is a continuation of copending application(s) Ser. No. 07/854,505 filed on Mar. 19, 1992, abandoned.

BACKGROUND OF THE INVENTION

This invention relates to luggage cases such as business or attache cases. More particularly, the invention relates to cases having two main compartments for carrying and, in some cases, organizing the contained personal and business related items, the compartments being separated from one another by an internal, hinged, divider panel.

Such cases fall in generally two groups: the first are softside cases made of fabric or leather-like material, often unstructured in a generally large envelope shape. The other general class of cases includes hard outer structure or covering divided into a lid shell and a base shell which are hinged together along the bottom side. The base shell usually has a handle attached to the top face for carrying. The lid shell and base shell are normally selectively held closed together with a latching device. In business cases, it is quite common to include a portfolio section comprising a number of vertically arranged flexible dividers which are attached to a divider panel hinged along the bottom inside edge of the lid shell. The entire portfolio construction is held on left and rights sides by flexible gusset panels which permit the divider panel and the intermediate dividers behind the divider panel to hinge out. This exposes papers, documents and the like for easy access.

The base shell generally provides a large compartment for carrying clothing items or stacks of papers, books and other items. An example of such a brief case is shown in U.S. Pat. No. 3,756,639 assigned to the assignee of the present invention. Here, in addition to showing the features mentioned above, the case includes a gravity responsive detent 41 which prevents the operation of the latch lever 17 if one tried to open the case upside-down. This prevents the papers held in the main shell from spilling out as is shown in FIG. 2 of that patent. U.S. Pat. No. 4,714,286 to Yamamoto, also assigned to the assignee of the present invention, shows an attache case with another gravity sensing feature. However, rather than preventing the case from opening at all if the case is improperly oriented, Yamamoto teaches providing gravity sensing means to control the extent of opening of the lid shell. In particular, if the case were lying in a horizontal position, the ball bearing detent located in a slot in the lid stays would permit the case to open fully. However, if the case were opened from a vertical position, the ball would fall into a slot to in effect shorten one arm of the stay. The lid shell would be prevented from opening fully, thus contents in the main shell of the case wold not tend to fall from the case. However, its likely that at least some of the contents of the main shell would fall to the bottom of the case even if such contents were prevented from falling completely out of the case. It would be difficult to shut the lid because of the accumulation of contents (papers, pencils, tape recorder, etc.) in the bottom of the case while the lid was even only partially opened.

One solution to this is shown in U.S. Pat. No. 3,112,017. Here, an attache case is shown with a divider panel hinged to the bottom wall of the base shell. When the divider 25 is clipped in place, the contents of the base shell are both hidden from view and generally prevented from falling out of the case should the case be opened in an other than horizontal position. The divider panel 25 provides a writing surface so that the case can be used as a desk. However, the divider panel 25 must be moved from one position to the other after the case is opened. Thus, if access to shirt 24 or the like was desired, the case must be opened, then the divider pad pulled from its latched position over the shirt and preferably holding devices 23 clipped to hold the divider pad in the vertical position within the lid while accessing articles 24.

Thus, none these prior art cases include means for automatically permitting access to either the contents of the portfolio portion while holding the contents of the main portion of the attache case from spilling out of the case or from moving to the bottom of the case. Nor do any of the above prior art cases provide means for automatically permitting access to the portfolio portion of the case when the case is opened from a vertical orientation and for permitting access to the contents in the base shell of the case when the case is opened from a horizontal position.

Also, these prior attache cases do not have a way of organizing small items, such as pencils, sunglasses, etc., for easy access when the case is only partially opened. Some prior cases have pencil boxes and such but they are arrayed along the hinged side of the case, thus requiring the user to fully open the case to easily access these small items. Also, many attache cases have small pockets along the front face of the portfolio divider panel for airline tickets, business cards and the like. Here again, in order to access these relatively small, flat items, the case must be substantially fully opened, thus exposing the contents of the base shell or permitting the displacement of such contents and thus preventing the case from fully closing again.

There have been business cases and hand luggage, both soft sided and hard sided, with exterior zippered pockets, extra pencils for accessing interior and exterior compartments and the like. Such extra compartments do permit selective access to the contents of the case, that is, they do keep portions of the case closed while one opens these extra compartments. However, such extra access openings complicate the construction of the case and must be provided separate locks and latches if such security is desired.

SUMMARY OF THE INVENTION

Accordingly, Applicant has invented a case comprising a base shell and a lid shell and a portfolio section normally carried in the lid shell, the portfolio comprising a front panel, hinged along a bottom edge thereof, and means for holding the front panel in an open or a closed position relative to the lid shell, and flexible gussets attaching the sides of the front panel and the sides of the lid shell.

The lid shell has a height dimension, the front panel of the portfolio extending only part of said height from the hinged side of the shell toward the upper edge of the shell. There is preferably provided a means at the upper edge of the divider panel for releasably attaching the divider panel to the lid shell or alternatively to the base shell whereby the degree of opening of the lid shell from the base shell about the hinge is limited by the extent of which the divider panel of the portfolio can be opened when the divider panel is attached to the base shell. This means for fastening comprises a protrusion means located on the front panel of the portfolio, a first means for releasably holding the protrusion carried by the base shell, and a second means carried by the lid shell for releasably holding the protrusion means.

Also provided is a case which has a lid shell and a base shell and means for selectively holding the lid shell and base shell together in the form of a latch, the lid shell being hinged to the base shell and the lid shell defining a lid compartment and the base shell defining a main compartment. There is an internal panel positioned within the case for closing the main compartment and the lid compartment. A first means is provided for automatically holding this panel in a first position wherein the panel closes off the main compartment when the case is opened from a generally vertical position. This means also automatically holds the panel in a second position wherein the panel closes off the lid compartment when the case is opened from a substantially horizontal position.

Also provided is a case which includes a lid shell, a base shell, a hinge along an adjoining edge of these shells, and means for selectively holding the lid shell and base shell together to shut the case. The lid shell defines a lid compartment and the base shell defines a main packing compartment. There is a portfolio normally carried in the lid compartment. This portfolio includes a panel defining the front of the portfolio and bellows gussets extending between the sides of this panel and the interior of the lid shell. Means are provided for holding this panel in alternate positions, this means being operable to either hold the panel in the first position within the lid shell or in the second position in the base shell, this selective positioning being operable while the lid shell and base shell are in the closed position. This means for operating comprises a first hook pivoted to the lid shell, this hook including a pendulum portion for sensing the direction of the pull of gravity to position the hook for engaging the front panel when the case is in a horizontal position and for releasing the panel when the case is in a vertical position, said means further including a second hook positioned and carried by the base shell. This second hook includes a pendulum means for sensing the direction of gravity and for positioning the hook for engaging the panel when the case is in the vertical position, but for releasing the panel when the case is in the horizontal position.

This first and second hook means are positioned relative to one another to engage one another when the case is in a vertical position. More particularly, this second hook includes a leg means which forces the first hook out of engagement with said panel when the second hook rotates in response to gravity when the case is a vertical position.

DETAILED DESCRIPTION OF THE PREFERRED EMBODIMENT

Figure 1:
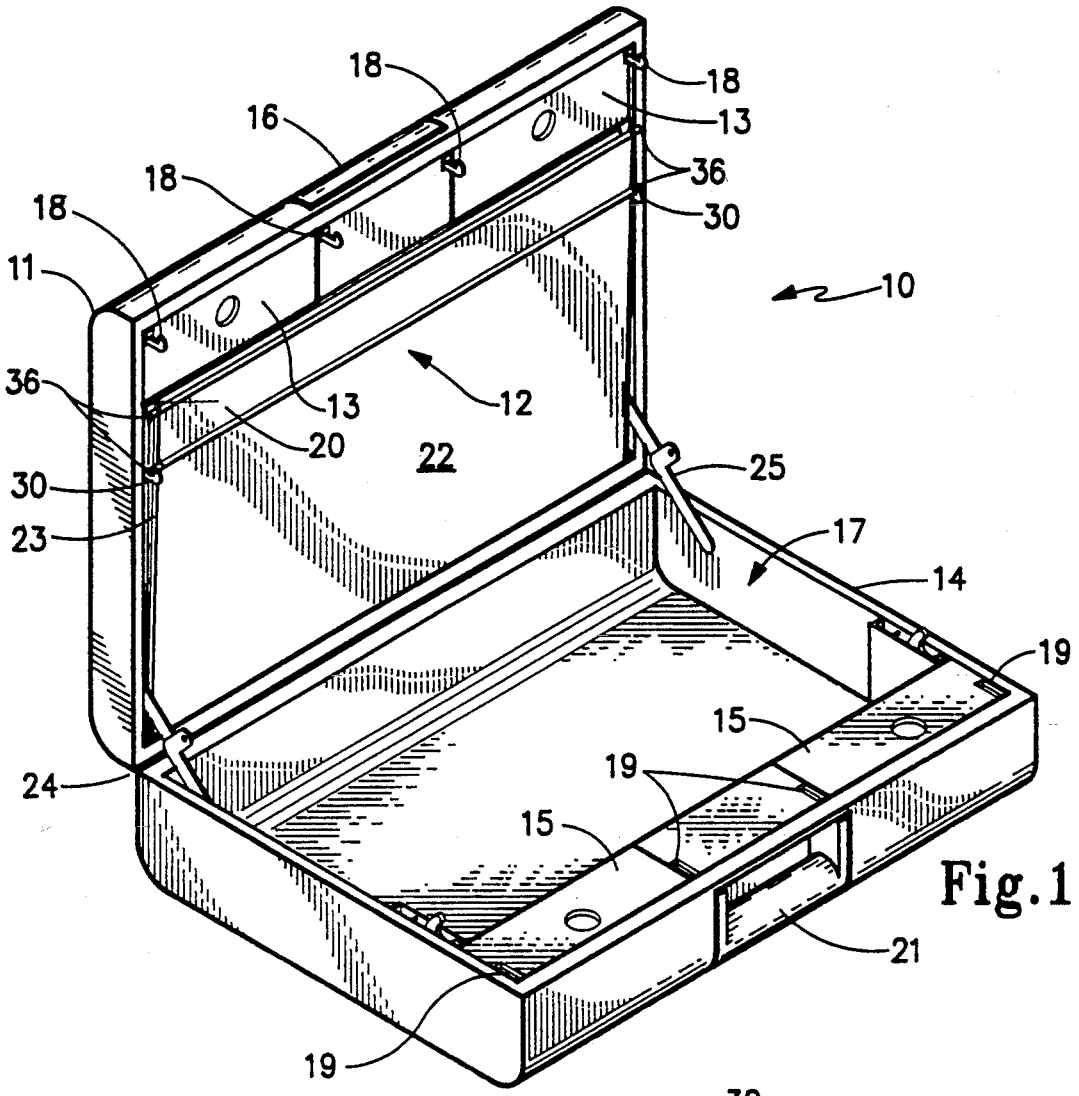
FIG. 1 shows an attache case according to the instant invention in an open position.

Attache case 10 has an overall shape and construction similar to prior art attache cases. As with such prior art cases, it includes a lid shell 11 which defines a lid compartment 12 defined by the space contained within the lid shell. The case further includes a base shell similar in construction to the lid shell 11. This base shell 14 defines a volume which comprises the main compartment 17, which typically is larger than the lid compartment 12. The lid shell 11 and base shell 14 are hinged together along their lower adjoining edges at 24 in a known manner. The lid shell and base shell are selectively held together by latch hooks 18 which are selectively received in latch hook receivers 19 in the base shell. The latch hooks 18 are operated by pivotally mounted latch lever 16 which rotates the hooks away from hooking engagement in receivers 19. This latching mechanism could include a locking device such as an ordinary key lock or perhaps a combination lock, as is well known in the luggage arts. The base shell includes a carrying handle 21, here shown as being inset in a cavity along the top side of the base shell. A more conventional handle arrangement with the handle or shoulder strap attached to a surface on the top side of the base shell is also contemplated.

The lid shell compartment is primarily occupied by a portfolio 20 which comprises a divider panel 22 of a generally thin but rigid, aesthetically pleasing material, and bellows gussets 23 made of a flexible cloth, leather, 3 or leather-like material. These bellows gussets have a generally triangular overall shape which permits the panel 22 to pivot about its lower edge at the lower side of the lid shell in the lid compartment to display the contents thereof.

To either side of the portfolio is a hinge stay 25 of known construction. This limits the range of pivoting of the lid shell 11 about hinge 24.

A pair of rod members 36 and 36 are attached along the upper horizontal edge of the panel 22. These rod members 36 form corresponding protruding ends beyond the sides thereof. The upper edge of the panel 22 defines the height of the portfolio which is substantially less than the overall height of the lid shell 11 and the lid compartment 12 defined therein. Within the space between the upper edge of the panel 22 and the upper edge of the shell compartment are one or more lid containers 13. These lid containers can take many forms such as zippered pouches made of leather or fabric, but in the preferred embodiment they are defined by boxes with simple spring-loaded, hinged doors which hinge about their lower edges to permit access to the compartment 13 defined therein. The importance of this novel arrangement will be set forth below.

Similarly the main compartment 17 includes one or more base containers 15. Like the lid containers 13, these containers can take many forms but are shown as being defined by a generally box-like construction with hinged lids which pivot about their lowermost edges (when the case is the vertical position). Here again, the significance of these compartments or containers and their position within the base shell will be set forth with greater detail.

The panel 22 is held in the position shown in FIG. 1 by a pair of portfolio catches 30 which engage the protruding ends of at least one of the rods 36.

Figure 2:
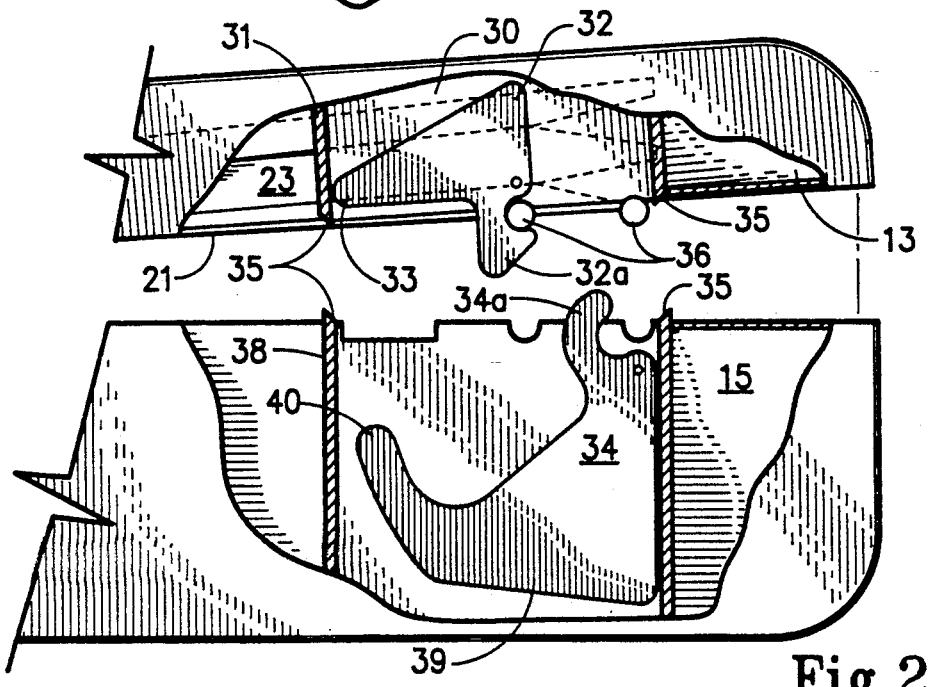
FIG. 2 shows a broken away portion of the case of FIG. 1 with the lid shell being opened from the horizontal position.

Referring to FIG. 2, the details of this arrangement are shown. The catch 30 comprises a box 31 which holds a first pivoting member 32 for relatively free pivotal movement about the axis shown. This first pivoting member includes a first hook 32*a* which can selectively engage the rod member 36 as shown. The first pivoting member 32 further includes a pendulum portion 33 which responds to the pull of gravity. In the position shown in FIG. 2, pendulum member 33 applies a counterclockwise rotating torque about the axis to place the hook member 32*a* in firm engagement with the protruding end of rod 36. A second box 38 is constructed similar to box 31 and positioned directly opposite thereof within the base compartment 17 and attached to the interior side walls of the base shell 14. The first box and second box may include mating surfaces 35 to help align these boxes and the members contained therein relative to one another when the lid shell and base shell are closed on one another.

A second pivoting member 34 is pivoted for free rotation to the inside of the second box 38. This second pivoting member has a second hook 34*a* which is integral with a second pendulum portion 39 which also responds to the pull of gravity by orienting itself with gravity. A protruding arm 40 forms part of the pendulum portion 39. As will be set forth, this protruding arm 40 can engage and, through the force of gravity on the pendulum member 34, rotate the first pivoting member 32 under certain conditions. The second box 38 includes semi-cylindrical indentations to receive and precisely position the rod members 36 when the lid shell and base shell are closed on to one another.

As shown in FIGS. 1 and 2, the panel 22 is held in a closed position by the hook portion 32*a* of first pivoting member 32. Thus, the portfolio catch 30, and its corresponding mate 30 on the other side of the case can be manually released from the portfolio when the case is positioned in FIG. 1 to permit access to the contents of the portfolio. Of course, the contents of the lid containers 13 and the base containers 15 can be easily had by flipping their doors open using the finger holes shown.

Figure 3:
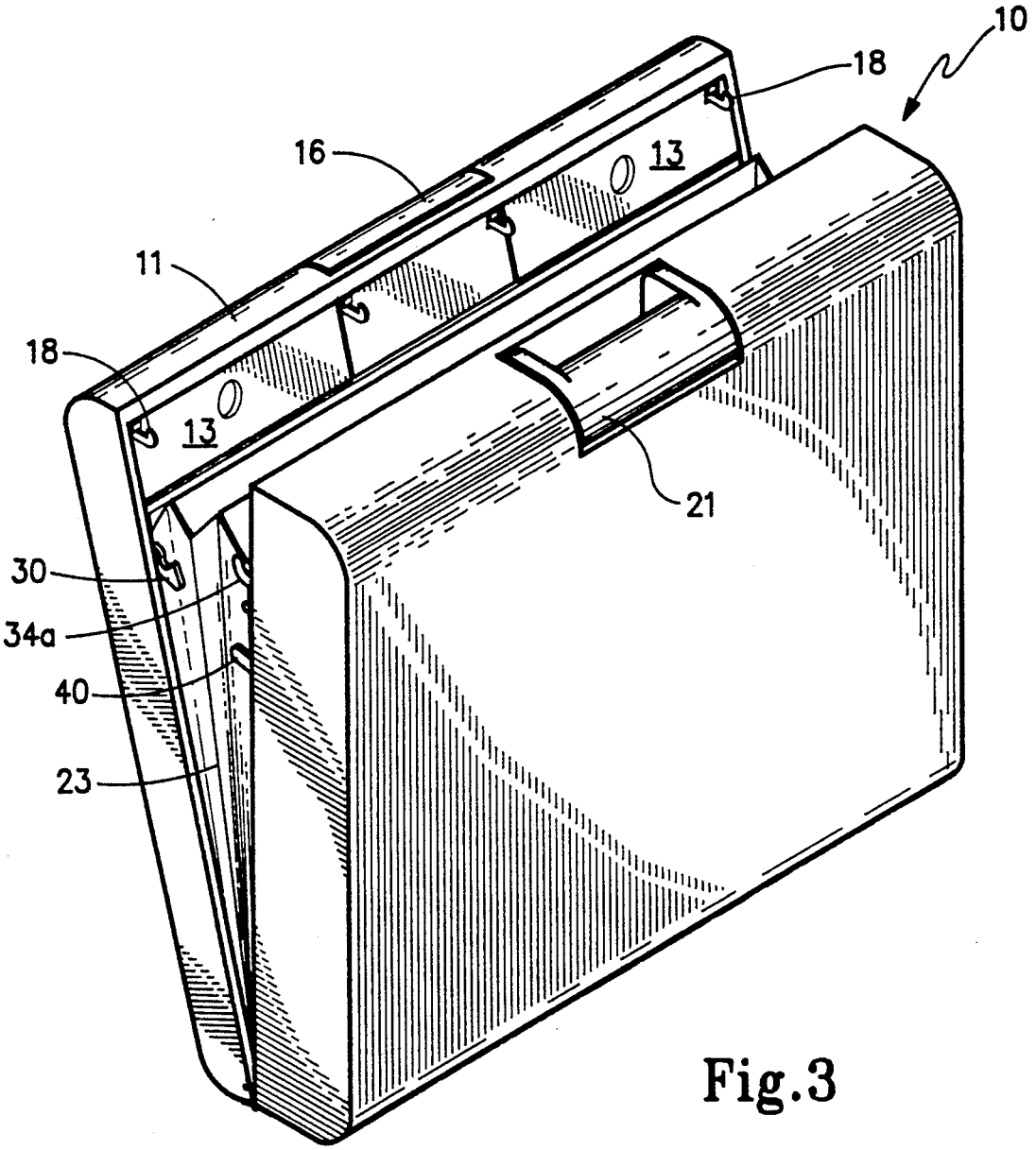
FIG. 3 shows the case of FIG. 1 after it has been opened in the vertical position.
Figure 4:
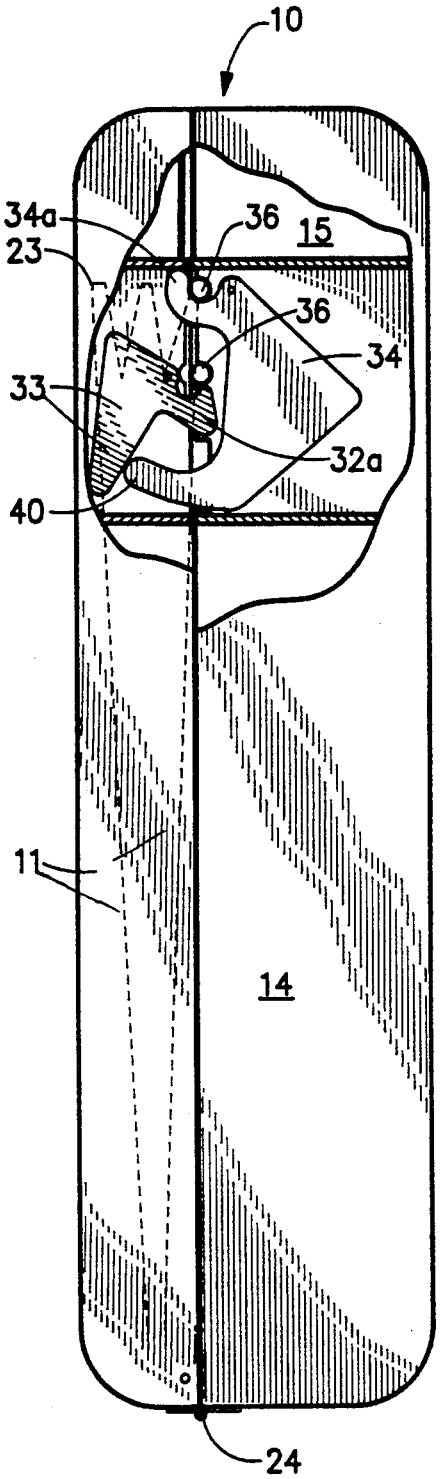
FIG. 4 is a partially broken away view of a detail of the attache case of FIG. 1.

When the lid shell and base shell are closed on to one another and moved from the horizontal position shown in FIGS. 1 and 2 to the vertical closed position shown in FIG. 3, the first and second pivoting members engage in one another to simultaneously cause the first rotating member 32 to release its hooked engagement from the end of the rod member 36 and to place the second hook member 34*a* into an engaging relationship with second rod member 36. This can best be seen with reference to FIG. 4. Here, the second pivoting member 34 has moved relative to the case in a clockwise direction. The mating surfaces 35 of the first and second boxes have positioned all the parts relative to one another precisely and the semi-cylindrical cutouts on the front face of the second box 38 have held both rods 36 and 36 in precise alignment with the various hook portions. Note that the second pivoting member 34 has rotated to bring the protruding arm 40 to engage the pendulum portion 33 of the first pivoting member 32. While the pendulum member 33 would tend to remain in the position shown in FIG. 2, it is overpowered by the greater mass of member 34 when the protruding arm 40 engages it. Thus, the first hook 32*a* disengages from the end of rod 36. If the case is opened from this vertical position wherein the second pivoting member 34 and its corresponding hook 34*a* have engaged the rod 36, the configuration in FIG. 5 will occur. In particular, the panel 22 is held by the second pivoting member 34 to close off most if not all of the base compartment 17 in the base shell 14. Simultaneously, the bellows gussets 23 are pulled into their open position to expose the contents of the portfolio 20. The gussets 23 are sized to permit the lid shell to open a substantial but limited degree. Thus, the degree to which the lid shell pivots open from this vertical orientation is limited by the bellows sides and not by the stays 25.

In this manner, the contents of the main compartment 17 are held in position, making it unlikely that the contents will spill down and prevent the case from shutting completely again. Also in the position shown in FIG. 5, access to the contents of the portfolio has been made very convenient with the various sections of the portfolio arrayed for access by the user from the top of the case. Also, the contents of lid containers 13 and the base containers 15 are readily accessible now since these containers are located along the upper edge of the lid and base shells flanking the open and arrayed contents of the portfolio section.

In this manner, the disclosed attache case has been made to be responsive automatically and immediately to the differing needs of the user, depending on whether the case is opened from the horizontal position or whether the case is opened from the vertical position. This novel functioning is done without the need for the user to first open the case and decide whether the main packing compartment 17 should be closed to access or inspection or whether the portfolio section should be opened for inspection. Thus, the disadvantages of the prior art cases are elegantly overcome. In each instance, when the case is opened from the vertical position, inadvertent spillage or visual access of the contents of the main compartment 17 are substantially prevented.

It should be understood that other arrangements are contemplated by the instant invention. While a pair of rods with protruding ends 36 and 36 are shown, an alternative construction is easily made where the hooks 32*a* and 34*a* need alternately engage only one rod. This can be easily done if the protruding leg 40 is offset slightly and the pivoting members 32 and 34 are offset from one another to permit the hook portions to pass one another and engage a different portion of the same rod 36. Also, while simple pendulum weights are shown, other gravity sensing means are contemplated. A mercury switch or some other orientation sensing means could control electromechanical catches to accomplish the same operation.

Figure 5:
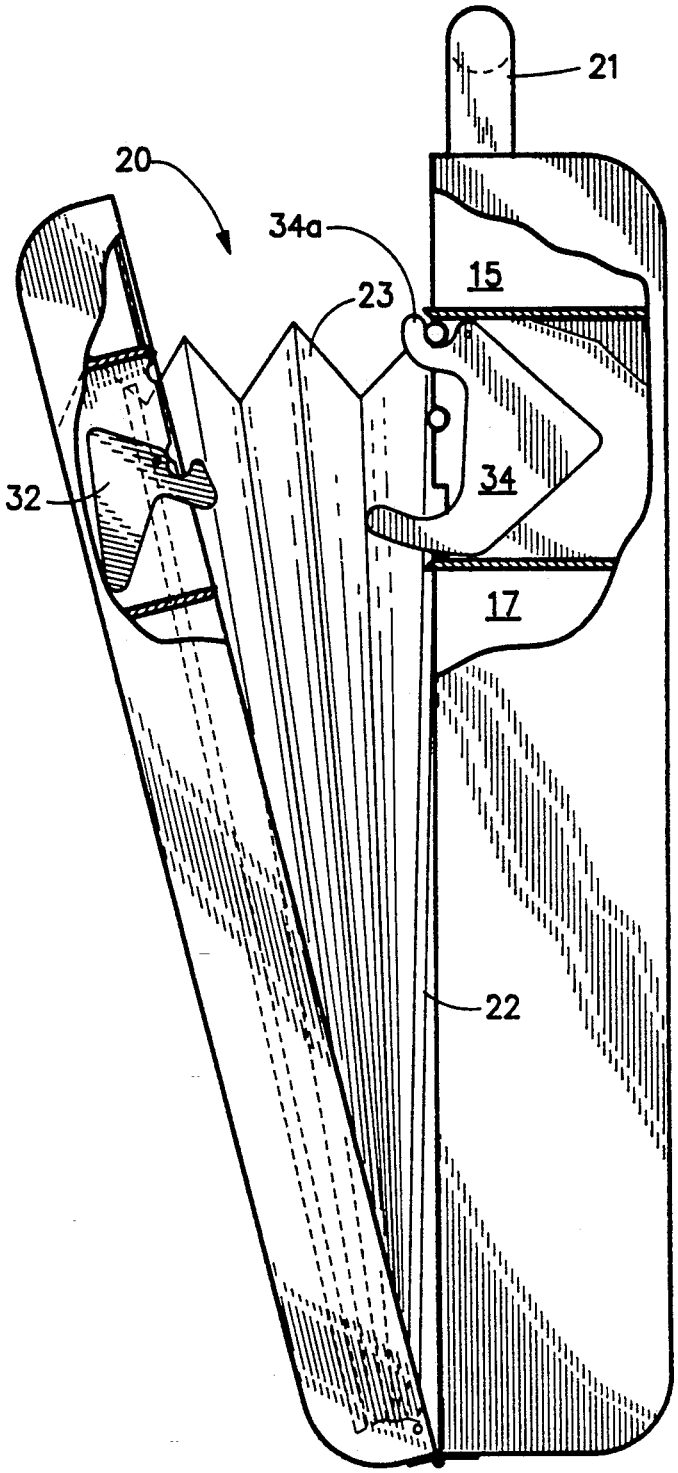
FIG. 5 is a view similar to FIG. 4 but showing the case after it has opened in the vertical position.

Also, while the orientation of the case is used to trigger the varying functions of the portfolio latch members, other means are within the scope of the invention. For example, a separate latch operable from the outside before the case is opened to either cause the panel to be fastened to the base shell or to be fastened to the lid shell is clearly possible. Also, the alternative attaching or hooking function could be triggered by the carrying handle 21. For example, a mechanical linkage between the handle 21 and the catches could be provided such that if the handle 21 is in the vertical position as shown in FIG. 5, the portfolio is held to the base shell as shown. However, if the handle 21 is in the position shown in FIG. 1, the panel is held in the closed position in the lid shell.

While this invention has been described with reference to a business case, the teachings could be easily applied to other types of hand luggage where outside pockets or access panels are inadequate or unavailable, but the user wishes to access the contents of the case lid and/or contents of small compartments arrayed along the upper portion of the case, while the case is in a vertical orientation.

I claim:

1. A case comprising a base shell, a lid shell hinged along a bottom side to the base shell, a handle at an upper side of said case, a divider panel positioned between the base shell and the lid shell which is hinged near said bottom side of the base shell inside the case, and means for holding the divider panel in an open or a closed position relative to the lid shell, the lid shell has a height dimension, the divider panel extending only part of said height dimension from the hinged side of the lid shell toward the upper edge of the case, at least one closeable pocket is positioned on the inside of at least one of the shells between the upper edge of the divider panel and the upper side of the case.

2. A case as set forth in claim 1 further comprising means for flexibly attaching the sides of the divider panel to the lid shell, and means at the upper edge of the divider panel for releasably attaching the divider panel to the lid shell or alternatively to the base shell whereby the degree of opening of the lid shell from the base shell about the hinged side is limited by the means for flexibly attaching the divider panel.

3. A case as set forth in claim 2 wherein said means for releasably fastening comprises a protrusion means located on said divider panel, a first means for releasably holding the protrusion to the base shell, and a second means carried by the lid shell for releasably holding the protrusion means to the lid shell.

4. A case as set forth in claim 3 wherein said means for releasably fastening comprises means for sensing the orientation of said case, whereby when said case is opened from a generally vertical orientation, said first means holds said protrusion means, and when said case is opened from a generally horizontal orientation, said second means holds said protrusion.

5. A case as set forth in claim 1 wherein said handle is attached to the base shell at the upper side of the case.

6. A case as set forth in claim 5 wherein said base shell has a cavity along the top side thereof and said handle is inset in said cavity.

7. A case having a lid shell and a base shell and latch means for selectively holding the lid shell and base shell together, the lid shell being hinged to the base shell and the lid shell defining a lid compartment and the base shell defining a main compartment, an internal panel positioned within the case for closing the main compartment and the lid compartment, means for automatically holding said panel in a first position wherein the panel closes off the main compartment when the case is opened from a generally vertical position, and for automatically holding the panel in a second position wherein the panel closes off the lid compartment when the case is opened from a substantially horizontal position.

8. A case as set forth in claim 7 wherein the case is an attache case and said panel is the front panel of a portfolio mounted in the lid compartment, said front panel is attached to the lid compartment by bellows gussets which permit the panel to hinge out from said lid compartment when said means for automatically holding is not holding said panel in said second position.

9. A case which includes a lid shell, a base shell, a hinge along an adjoining edge of these shells, and latch means for selectively holding the lid shell and base shell together in a closed position to shut the case, the lid shell defines a lid compartment and the base shell defines a main compartment, a portfolio normally carried in the lid compartment, the portfolio including a panel defining the front of the portfolio and flexible gussets extending between the sides of the panel and the lid shell, means for holding the panel in alternate positions, this means being operable to either selectively hold the panel in the first position within the lid shell or in the second position to selectively hold the panel to the base shell, both selective holding operations of said means being operable while the lid shell and base shell are in the closed position.

10. A case as set forth in claim 9 wherein this means for holding comprises a first hook carried by the lid shell having a pendulum portion for sensing the direction of the pull of gravity thereby positioning the hook for engaging the panel when the case is in a horizontal position and for releasing the panel when the case is in a vertical position, said means further including a second hook carried by the base shell, the second hook including a pendulum portion for sensing the direction of gravity for engaging the panel when the case is in the vertical position and for releasing the panel when the case is in the horizontal position.

11. A case as set forth in claim 10 wherein the first and second hooks are positioned relative to one another to selectively engage one another depending on whether the case is in a vertical position or a horizontal position.

12. A case as set forth in claim 11 wherein the second hook includes a leg means which contacts the first hook and forces the first hook out of engagement with said panel when the second hook rotates in response to gravity when the case is rotated to a vertical position.

* * * * *